United States Patent [19]

Kato

[11] Patent Number: 4,887,987

[45] Date of Patent: Dec. 19, 1989

[54] INFLATABLE EMERGENCY FLOTATION DEVICE

[75] Inventor: Csaba Kato, Houston, Tex.

[73] Assignee: Aquasafe, Inc., Lorain, Ohio

[21] Appl. No.: 179,937

[22] Filed: Apr. 11, 1988

[51] Int. Cl.[4] ..... B63C 9/16

[52] U.S. Cl. ..... 441/96; 441/113; 441/123

[58] Field of Search ..... 441/90, 96, 97, 98, 441/99, 106, 108, 111, 112, 113, 117, 118, 123

[56] References Cited

U.S. PATENT DOCUMENTS

| | | | |
|---|---|---|---|
| Re. 31,305 | 7/1983 | Moran . | |
| 635,439 | 10/1899 | Kunert | 441/113 |
| 1,856,632 | 5/1932 | Haines . | |
| 2,703,891 | 3/1955 | Mayer | 441/96 |
| 2,748,047 | 5/1956 | Kuss . | |
| 2,784,426 | 3/1957 | Boyle et al. | 441/113 |
| 2,895,147 | 7/1959 | Desjarlais et al. | 441/96 |
| 3,103,022 | 9/1963 | Harding et al. . | |
| 3,104,403 | 9/1963 | Lortz | 441/99 |
| 3,754,731 | 8/1973 | Mackal et al. . | |
| 3,809,288 | 4/1974 | Mackal . | |
| 4,060,867 | 12/1977 | Miller . | |
| 4,150,464 | 4/1979 | Tracy . | |
| 4,171,555 | 10/1979 | Bakker et al. . | |
| 4,348,449 | 9/1982 | Seufert . | |
| 4,379,705 | 4/1983 | Saotome . | |
| 4,496,328 | 1/1985 | Asher et al. | 441/108 |

FOREIGN PATENT DOCUMENTS

| | | | |
|---|---|---|---|
| 2360740 | 6/1975 | Fed. Rep. of Germany | 441/123 |
| 8504634 | 10/1985 | World Int. Prop. O. | 441/106 |

*Primary Examiner*—Sherman D. Basinger
*Assistant Examiner*—Stephen P. Avila
*Attorney, Agent, or Firm*—Cushman, Cushman, Darby

[57] ABSTRACT

An inflatable emergency flotation device to be worn around the neck of the wearer and strapped to the front of the wearer's body. The device includes a folded, flexible, airtight tube; a strap which is slidably attached to the ends of the tube; an oral inflation tube; and an inflation assembly including a holder for holding a carbon dioxide cylinder and a hand operated or automatic activating mechanism.

8 Claims, 2 Drawing Sheets

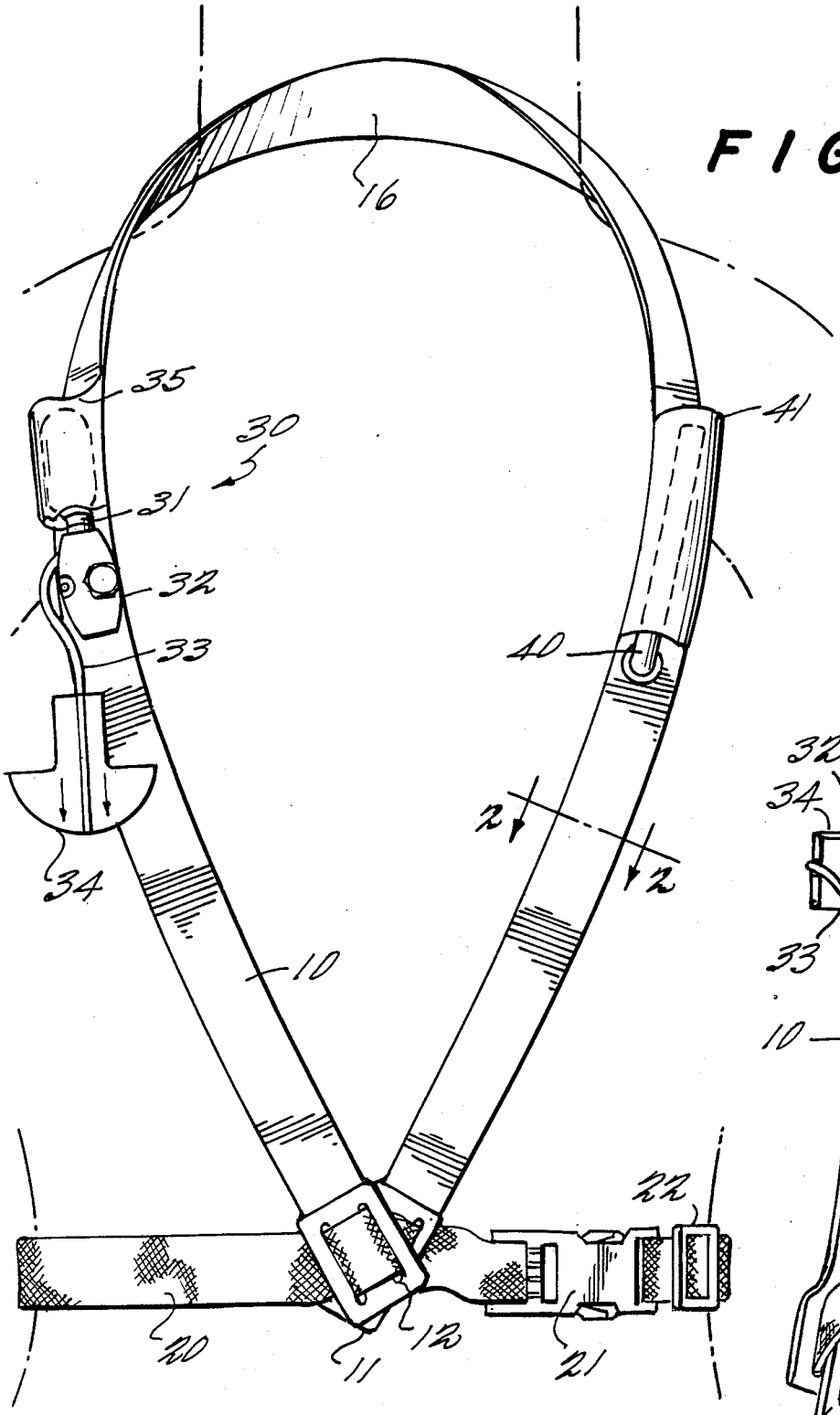
FIG. 1
FIG. 5
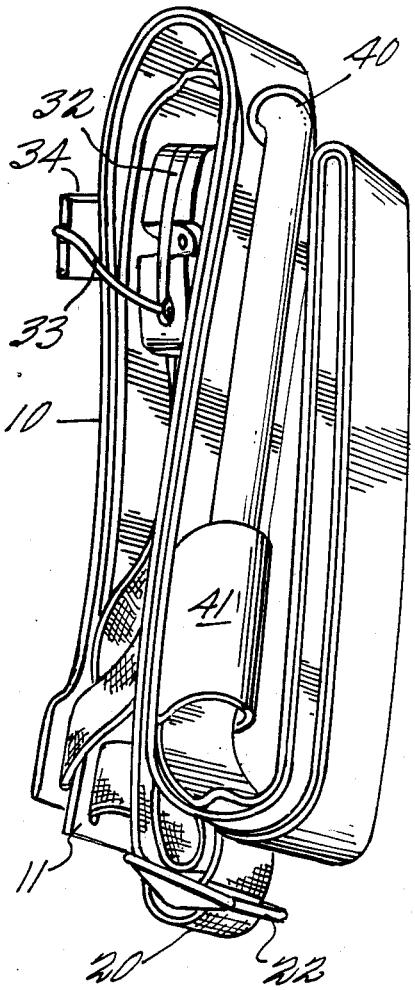

INFLATABLE EMERGENCY FLOTATION DEVICE

BACKGROUND OF THE INVENTION

The invention relates to an inflatable emergency flotation device.

Several inflatable flotation devices are known in the art.

U.S. Pat. No. 4,060,867 discloses a life vest having two inflatable chambers in order to provide adjustable buoyancy.

Reissue Patent No. 31,305 discloses an inflatable life preserver to be worn around the neck having a releasable three layer protective covering for inflatable cells.

U.S. Pat. No. 3,103,022 disclosed an inflatable life preserver designed for military use and intended to be worn about the neck. The preserver has an outer textile casing which is to be rolled up in its deflated condition so as not to hamper the physical activities of the wearer.

U.S. Pat. No. 4,379,705 discloses an inflatable life belt made of rubber, which, in its uninflated condition fits around the wearer's waist and in its inflated condition is positioned under the arms of the user.

U.S. Pat. No. 1,856,632 discloses a flexible tubular bathing belt meant to be worn in its uninflated condition as a belt for supporting or confining a garment. The belt is held in a pleated or folded position by straps in which the pleated ends of the fabric are embedded.

A disadvantage of many prior art inflatable emergency flotation devices is their bulk in the uninflated condition, both when being worn on the body of the user and when packed for storage for shipping or travel or on board a vessel or aircraft. Many other prior art flotation devices are ineffective in keeping the head of a person above water when the device is used for emergency survival.

SUMMARY OF THE INVENTION

Therefore the object of the present invention is to provide an inflatable emergency flotation device which is convenient to store and wear because it takes up little space in its uninflated condition and can be comfortably worn flat against the body of the user, as well as a device which is effective in keeping the body of a conscious or unconscious person afloat in water in a head up position (see FIG. 3) and thereby prevent drowning in emergency situations.

A further object of the invention is to provide an emergency flotation device having an inflatable tube which is to be worn around the back of the neck and strapped onto the front of the wearer's body and which folds into a flat conformation in its uninflated condition.

Therefore the present invention provides an inflatable emergency flotation device comprising a folded, flexible, airtight tube long enough to be worn around a person's neck and extend downward to about a person's waist, the tube being made from a sheet of flexible material having at least three creases and one seam running lengthwise of the tube such that it may be readily flattened and folded lengthwise at least once to form a narrow strip, and the tube having two ends formed integrally with the tube and having slots or other means for slidably attaching a strap to each of the ends. The strap is slidably attached to the two ends of the tube for securing the two ends of the tube to the front portion of the wearer's body, the strap having two ends and a buckle or other means for attaching the two ends to each other and means for adjusting the length of the strap. The device also comprises an inflation assembly having means for holding a carbon dioxide cylinder and a manifold or other device for releasing the compressed gas into the tube to cause the tube to inflate and unfold. The inflation assembly may comprise a manually operated or an automatic manifold activator which causes the carbon dioxide cylinder to be activated upon contact with water. The device comprises an oral inflation tube in communication with the tube for inflating the tube by blowing air into the oral inflation tube.

BRIEF DESCRIPTION OF THE DRAWINGS

FIG. 1 is a front view of the device when worn in its inactive and uninflated condition.

FIG. 5 is a view of the device in a compacted folded position for storage.

DETAILED DESCRIPTION OF THE PREFERRED EMBODIMENT

The tube (10) is made of a flexible thermoplastic sheet material such as polyether polyurethane film. The preferred material is TUFTANE® TFX-4E supplied by Lord Film Products.

The tube (10) is made from a single sheet of flexible sheet material which is folded in half lengthwise. A seam (13) is formed by heat-sealing two long edges of the sheet together by known methods such as high frequency heat-sealing in order to make an airtight seal.

Figure 3:
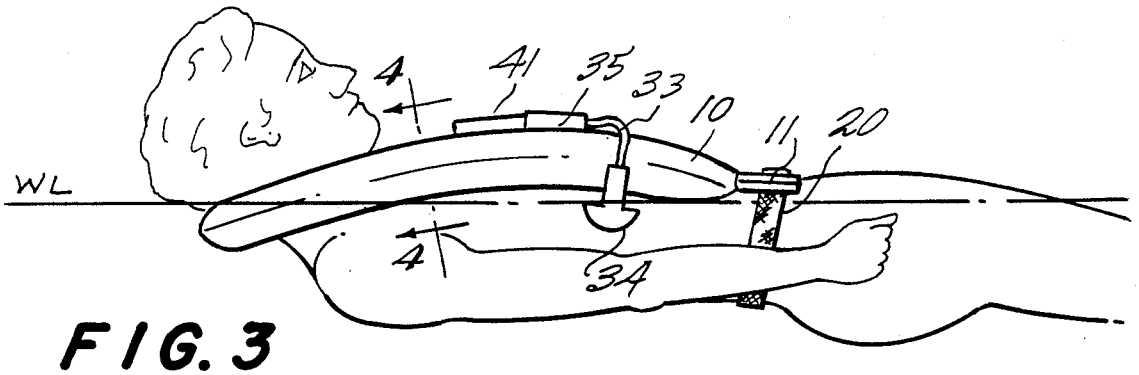
FIG. 3 is a side view of the device as it is worn in its active and inflated condition keeping a person afloat in the water.
Figure 2:
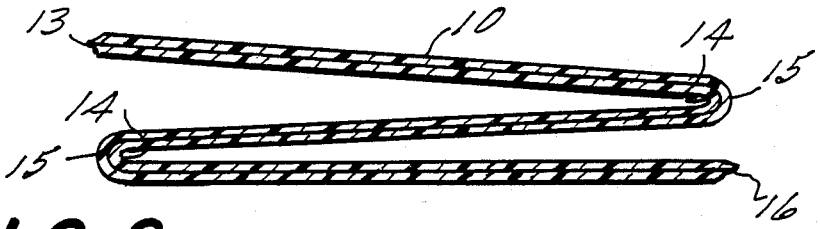
FIG. 2 is a view of the cross-section of the tube of the device taken at line 2—2 in FIG. 1.
Figure 4:
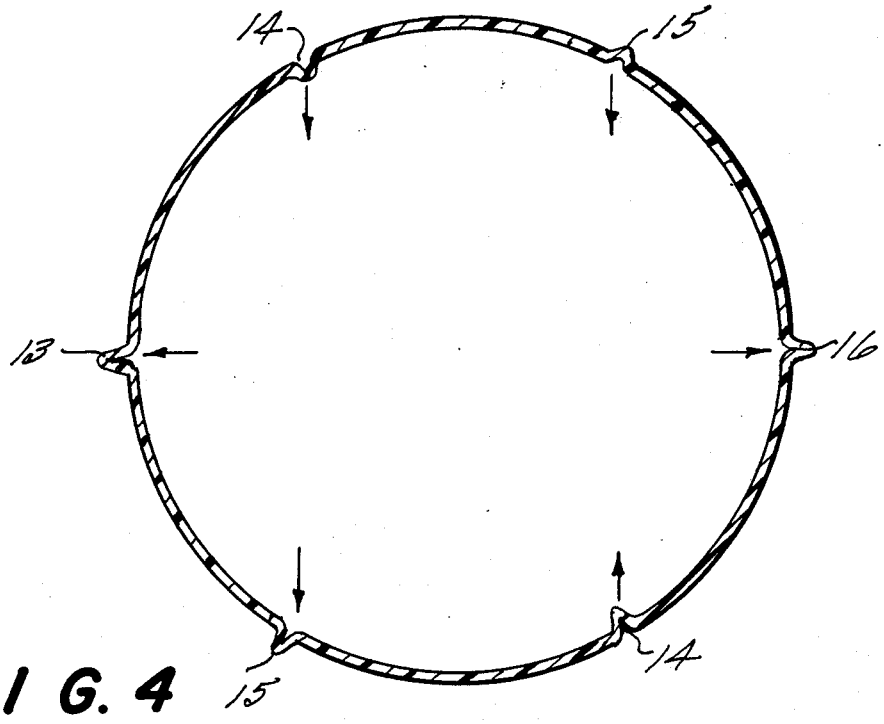
FIG. 4 is a view of the cross-section of the tube of the device taken at line 4—4 in FIG. 3.

After forming the seam (13), at least one crease line is formed running lengthwise of the tube (10) in order to cause the tube to be readily folded into a narrow strip. Crease line (16) is located opposite seam (13) and permits the tube (10) to be flattened. If a single crease line is formed, the flattened tube (10) is folded in half. If two crease lines are formed the flattened tube (10) is folded in thirds in a "Z" formation as shown in FIG. 2. If more than three crease lines are formed, multiple folds are made in an accordion fashion so that the flattened tube (10) is readily unfolded when filled with air. Thus adjacent crease lines cause folding in opposite directions. In FIGS. 2 and 4, reference numeral (14) indicates an inward crease and reference numeral (15) indicates an outward crease in the tube (10). In FIG. 4, the arrows indicate the movement of the sides of the tube (10) when it is deflated. The creases are formed in the thermoplastic sheet material according to known methods. See, e.g., U.S. Pat. No. 4,348,449.

The tube (10) may be manufactured in various sizes to fit different sized adults, children and infants. The length of the tube (10) varies from 30 to 64 inches. The width of the tube (10) varies from 4 to 6 inches in its unfolded, uninflated, flat condition. Each different sized inflatable emergency flotatation device is recommended for wearers having a certain range of body weights. In the preferred embodiment, the tube (10) is folded three times, so that the width of the folded, uninflated flat tube (10) is about 1 to 2 inches. The width of the tube (10) is usually uniform throughout the length of the tube. There is no reduction in width around the midpoint of the tube which supports the wearer's head above water in the inflated condition.

The two ends of the tube (10) are heat-sealed, preferably by high frequency heat-sealing. In the preferred embodiment of the device, about two inches of the end portion of the tube (10) are fused together by heat-sealing such that the several folded layers of thermoplastic material form a laminated end portion (11). The high frequency heat-sealing is performed according to known methods. The end portions (11) assist the tube (10) in returning to the desired folded position when the tube (10) is deflated.

In the preferred embodiment, two parallel elongated holes (12) are formed in each of the two laminated end portions of the tube (10). The elongated holes may be reinforced according to known methods. See, e.g., U.S. Pat. No. 2,748,047. The two elongated holes form the slots through which the strap (20) may be slidably attached to the two ends of the tube (10). Thus, the means for attaching the strap (20) to the tube (10) is integral with the tube (10) itself.

The strap (20) is made of durable, water resistant fabric such as woven nylon or polyester. The strap (20) is slidably attached to each of the two ends of the tube (10) so that when the strap (20) is wrapped around the waist of the wearer, the tube (10) is held snugly against the front portion of the body of the wearer. The strap (20) is provided with a buckle (21) in order to fasten the two ends of the strap (20) together. The buckle (21) is preferably similar to the type shown in U.S. Pat. Nos. 4,171,555 and 4,150,464. The strap (20) is also provided with means (22) for adjusting the length of the strap (20). In the preferred embodiment, one end of the strap (20) is looped around a first portion of the buckle and sewn to the strap (20). The other end of the strap (20) is looped around the second portion of the buckle and then attached to the center portion of a clasp (22) which frictionally slides along the strap (20). In this manner, the length of the strap (20) may be adjusted to fit different sized waists.

The inflatable emergency flotation device according to the invention also includes an inflation assembly (30). The inflation assembly (30) includes a carbon dioxide cylinder (31) and means for releasing the compressed gas into the tube (10). In the preferred embodiment, the inflation assembly is the manifold, valve and flange assembly according to U.S. Pat. Nos. 3,754,731 and 3,809,288. Accordingly, the assembly comprises a molded plastic activator housing (32) provided with a metal threaded sleeve into which the carbon dioxide cylinder is screwed in order to form a hermetic seal. The activator housing (32) fits over a metal tube-shaped check valve which is connected and sealed to a heat-sealed plastic crimp flange which is in turn heat-sealed to a wall of the tube (10) at a hole therethrough. The activator housing may be provided with manually operated or automatic activating means. In the manually operated mode, a lever (33) is movably attached to the activator housing; the lever (33) moves a cylinder-piercing needle to puncture the end of the carbon dioxide cylinder which is inside the activator housing. A lanyard cord is securely attached to the lever (33) and to a handle (34) which is pulled by the wearer of the device to activate the inflation assembly. In the automatically activated mode of the inflation assembly, the activator housing (32) is provided with an automatic activating mechanism which automatically inflates tube (10) within five seconds upon immersion in water. The preferred automatic activating mechanism is ROBERTS ®840-AMA series Auto-Inflator supplied by Halkey-Roberts Corporation.

The inflation assembly (30) is positioned on one side of the tube (10) about midway between one end (11) and the midpoint of the tube (10). A piece of flexible thermoplastic sheet material (35) is inserted in seam (13) and positioned so as to form a loop which covers the carbon dioxide cylinder (31).

The inflatable emergency flotation device also includes an oral inflation tube (40) positioned on the other side of the tube (10) midway between the other end (11) and the midpoint of the tube (10). The oral inflation tube (40) comprises a flexible tube having a check valve near the outer end of the tube. The oral inflation tube is similar to other oral inflation tubes known in the art. A piece of flexible thermoplastic sheet material (41) is inserted in seam (13) and positioned so as to form a loop which covers the oral inflation tube (40) such that it is held against the tube (10) when not in use but can be easily removed from the loop when needed.

The inflatable emergency flotation device may be deflated by removing the carbon dioxide cylinder from the activator housing (32) and/or depressing the top of the oral inflation tube (40). The gas may be expelled from the tube by running fingers along the length of the tube and flattening the tube so that it can be refolded. The preferred embodiment of the inflatable emergency flotation device is easily folded into a small package for storage. The folded device takes up as little as about $7\frac{1}{2}'' \times 2\frac{1}{2}'' \times 2\frac{1}{2}$ space.

Other embodiments of the invention will be apparent to those skilled in the art.

We claim:

1. An inflatable emergency flotation device to be worn around the back of the neck of the wearer and strapped to the front of the wearer's body for holding the head of a conscious or unconscious person up above water, the device comprising:

(a) folded, flexible, airtight tube means long enough to be worn looped around a person's neck and extending downward to about a person's waist, said tube means being made from a sheet of substantially constant with flexible thermoplastic material having at least three pre-formed, permanent creases extending lengthwise of said tube means and one seam running lengthwise of said tube means such that said tube means is predisposed to remain flattened when non-inflated and can be readily folded lengthwise at least once to form a folded, flat narrow strip, and said tube means having two tube ends formed integrally with said tube means, each said tube end being constituted by a respective end portion of said tube means heat sealed together crosswise thereof and throughout the thickness thereof while folded along all of said creases, so as to form a respective laminate; said tube ends being provided with means for slidably attaching a strap to both of said tube ends;

(b) a strap slidably attached to said means for slidably attaching a strap to tube ends for securing said tube means to the front portion of the wearer's body, said strap having two strap ends and means for detachably fastening said strap ends to each other and means for adjusting the length of said strap;

(c) an inflation assembly having means for holding a carbon dioxide cylinder and means for releasing compressed gas into said tube means to cause said tube means to inflate and unfold;

(d) an oral inflation tube in communication with said tube means about one-quarter of the way along said tube means from one said tube end for inflating said tube means by blowing air into said oral inflation tube.

2. The inflatable emergency flotation device according to claim 1, wherein said sheet of flexible thermoplastic material has five creases, a first crease opposite the seam, which first crease enables said tube means to flatten, and two pairs of creases positioned one-third and two-thirds of the distance from the seam to the first crease, which two pairs of creases enable said tube means to fold into a strip one-third the width of said tube means when flattened.

3. The inflatable emergency flotation device according to claim 1, wherein said means for slidably attaching said strap to each of said tube ends consists of two parallel elongated holes formed in each of said tube ends.

4. The inflatable emergency flotation device according to claim 1 further comprising a piece of flexible thermoplastic sheet material inserted in said seam in said sheet of thermoplastic material and positioned so a to form a loop which covers said carbon dioxide cylinder.

5. The inflatable emergency flotation device according to claim 1 further comprising a piece of flexible thermoplastic sheet material inserted in said seam in said sheet of thermoplastic material and positioned so as to form a loop which covers said oral inflation tube.

6. The inflatable emergency flotation device according to claim 1, wherein said means for releasing compressed gas comprises an automatic activating mechanism which automatically inflates said tube means upon immersion in water.

7. The inflatable emergency flotation device according to claim 1, wherein said means for releasing compressed gas comprises a manually operated mechanism for inflating said tube means.

8. The inflatable emergency flotation device according to claim 1, wherein said flexible thermoplastic sheet material is aromatic polyether polyurethane film.

* * * * *